US009365047B2

(12) United States Patent
Kurokawa et al.

(10) Patent No.: US 9,365,047 B2
(45) Date of Patent: Jun. 14, 2016

(54) INKJET PRINTING APPARATUS AND PRINTING METHOD OF INSPECTING CHART THEREWITH

(71) Applicant: SCREEN Holdings Co., Ltd., Kyoto (JP)

(72) Inventors: Yuji Kurokawa, Kyoto (JP); Atsushi Imamura, Kyoto (JP)

(73) Assignees: SCREEN Holdings Co., Ltd. (JP); RICOH COMPANY, LTD. (JP)

( * ) Notice: Subject to any disclaimer, the term of this patent is extended or adjusted under 35 U.S.C. 154(b) by 0 days.

(21) Appl. No.: 14/630,116

(22) Filed: Feb. 24, 2015

(65) Prior Publication Data

US 2015/0273918 A1 Oct. 1, 2015

(30) Foreign Application Priority Data

Mar. 25, 2014 (JP) ..... 2014-061964

(51) Int. Cl.
*B41J 29/393* (2006.01)
*B41J 2/21* (2006.01)

(52) U.S. Cl.
CPC ..... *B41J 2/2142* (2013.01); *B41J 2/2114* (2013.01)

(58) Field of Classification Search
CPC ..... B41J 2/2114
See application file for complete search history.

(56) References Cited

U.S. PATENT DOCUMENTS

2012/0313992 A1* 12/2012 Wada et al. ..... 347/15

FOREIGN PATENT DOCUMENTS

JP 2003-251243 9/2003

* cited by examiner

*Primary Examiner* — Julian Huffman
(74) *Attorney, Agent, or Firm* — Ostrolenk Faber LLP

(57) ABSTRACT

Disclosed is an inkjet printing apparatus including a printing head, an overcoating head discharging an overcoating agent, and a controller operating the printing head and the overcoating head to perform printing to a print medium. The controller operates in a normal discharge mode having a printing rate in the print medium relative to a given area of less than 100% for printing to the print medium, and an inspecting discharge mode having a printing rate in the print medium relative to the given area higher than the printing rate of the normal discharge mode for confirming a discharge state of the overcoating agent. In the inspecting discharge mode, the controller operates the printing head to form an inspecting region on the print medium, and operates the overcoating head to discharge the overcoating agent onto the inspecting region, whereby an overcoating inspecting chart is formed.

10 Claims, 4 Drawing Sheets

INKJET PRINTING APPARATUS AND PRINTING METHOD OF INSPECTING CHART THEREWITH

TECHNICAL FIELD

The present invention relate to an inkjet printing apparatus for discharging ink droplets to print an image and a printing method of an inspecting chart with the inkjet printing apparatus. More particularly, the present invention is directed to a technique of confirming an overcoating agent printed for protecting a printing surface.

BACKGROUND ART

A typical inkjet printing apparatus discharges visual ink droplets in cyan (C), magenta (M), yellow (Y), and black (K) from individual printing head to a printing sheet for printing images. In addition, an overcoating agent is applied to a printing sheet, especially to a coated paper, after image printing to obtain an enhanced texture after printing such as a feeling of glossiness or enhanced friction resistance. It is presupposed that the overcoating agent is applied to an image region printed in advance. A transparent (invisible) material is discharged as the overcoating agent from a printing head having an identical construction to that used for the individual visible color.

Here, the overcoating agent is transparent. Accordingly, it is difficult on the printing sheet to visually confirm whether or not the overcoating agent is discharged from all nozzles of an overcoating printing head. Consequently, such an apparatus as under has been suggested for confirming application of the overcoating agent. That is, for confirming discharge of the overcoating agent, an overcoating agent is applied and thereafter an image recognition camera recognizes the overcoating agent. Examples of the overcoating agent include an overcoating agent sensitive to fluorescence or infrared light and an overcoating agent containing an ultraviolet absorbing additive agent. See, for example, Japanese Patent Publication No. 2003-251243A.

However, the example of the currently-used apparatus with such a construction as above has the following drawback.

That is, the currently-used apparatus possesses a drawback that a special overcoating agent and an image recognition camera result in an increased apparatus cost.

SUMMARY OF INVENTION

The present invention has been made regarding the state of the art noted above, and its one object is to provide an inkjet printing apparatus and an inspecting chart printing method with the apparatus that allow confirmation of a discharge state of an overcoating agent readily at low prices.

In order to accomplish the above object, the present invention adopts the following construction. One embodiment of the present invention discloses an inkjet printing apparatus for discharging ink droplets and an overcoating agent. The apparatus includes a printing head discharging the ink droplets, an overcoating head discharging the overcoating agent, and a controller operating the printing head and the overcoating head to perform printing to a print medium. The controller operates in a normal discharge mode and an inspecting discharge mode. The normal discharge mode has a printing rate in the print medium relative to a given area of less than 100% for the printing to the print medium. The inspecting discharge mode has a printing rate in the print medium relative to the given area higher than the printing rate of the normal discharge mode for confirming a discharge state of the overcoating agent. In the inspecting discharge mode, the controller operates the printing head to form an inspecting region on the print medium, and operates the overcoating head to discharge the overcoating agent onto the inspecting region, whereby an overcoating inspecting chart is formed.

With the embodiment of the present invention, the controller operates the printing head to form the inspecting region on the print medium, and operates the overcoating head to discharge the overcoating agent onto the inspecting region in the inspecting discharge mode. Consequently, the overcoating inspecting chart is formed. The inspecting region is printed in the inspecting discharge mode. Accordingly, the inspecting region is printed in a condition more solid than the normal discharge mode. As a result, the inspecting region has ink evenness higher than the inspecting region printed in the normal discharge mode. Moreover, the overcoating agent is discharged onto a sheet with difficulty in absorbing ink droplets, such as a coated paper, prior to absorption of the ink droplets into the sheet. This causes bleeding of the ink droplets and change in color of the ink droplets. Consequently, the overcoating inspecting chart obtains an enhanced visibility even with an invisible overcoating agent. As a result, a discharge state of the overcoating agent can be confirmed readily at low prices without a special overcoating agent.

Moreover, it is preferable that the inspecting region according to the embodiment of the present invention is formed by discharging ink droplets in cyan (C) from the printing head.

The inspecting region colored in cyan achieves the overcoating inspecting chart with an enhanced visibility due to the bleeding overcoating agent.

Moreover, the following is preferable. That is, the printing head in the embodiment of the present invention includes a plurality of printing heads, and one of the plurality on the uppermost stream side discharges ink droplets in black (K). The controller operates the printing head discharging the ink droplets in black (K) to print a first pattern and a second pattern in a region corresponding to the inspecting region, and operates the overcoating head to discharge the overcoating agent so as for the overcoating agent to overlap the first pattern and the second pattern. The first pattern is drawn along a transportation direction, and the second pattern is drawn in a direction orthogonal to the transportation direction.

Accordingly, an overlap condition of the first pattern and the second pattern allows confirmation of difference in discharge position between the printing head for black (K) and the overcoating head. Consequently, the discharge position of the overcoating agent can conform to the discharge position for black (K) as a reference position.

Moreover, it is preferable that the controller according to the embodiment of the present invention operates adjacent nozzles of a plurality of nozzles of the overcoating head arranged in the direction orthogonal to the transportation direction to perform discharge with shift in the transportation direction, whereby the overcoating inspecting chart is formed.

Accordingly, the overcoating agent from the adjacent nozzles is visible even when the overcoating agent spreads in the inspecting region. This achieves confirmation of a discharge state of the overcoating agent from each of the nozzles.

It is to be understood that both the foregoing general description and the following detailed description are exemplary and explanatory and are intended to provide further explanation of the invention as claimed.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

The following describes one embodiment of the present invention with reference to the drawings.

Figure 1:
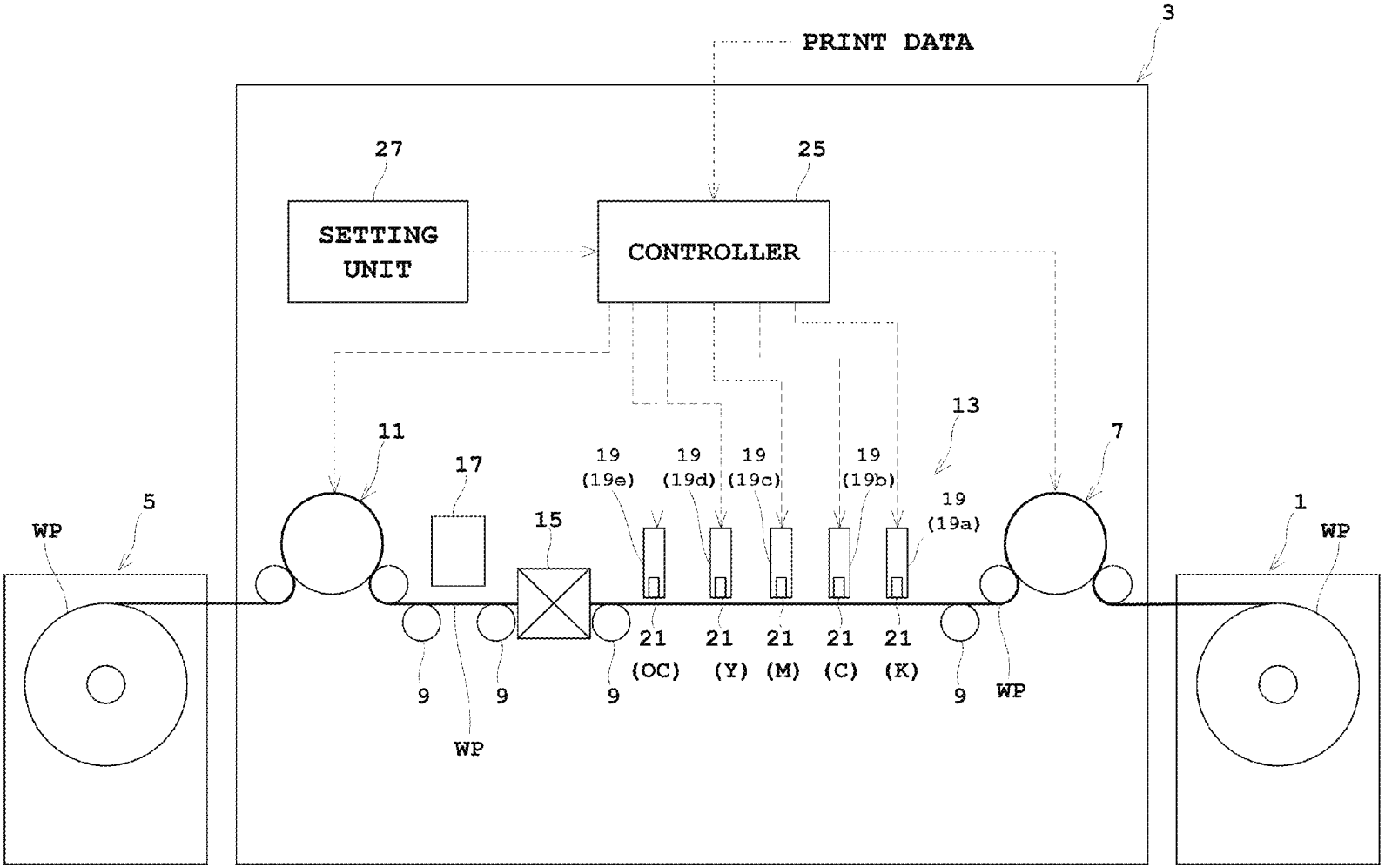
FIG. 1 is a schematic view illustrating an entire inkjet printing system according to one embodiment of the present invention.
Figure 2:
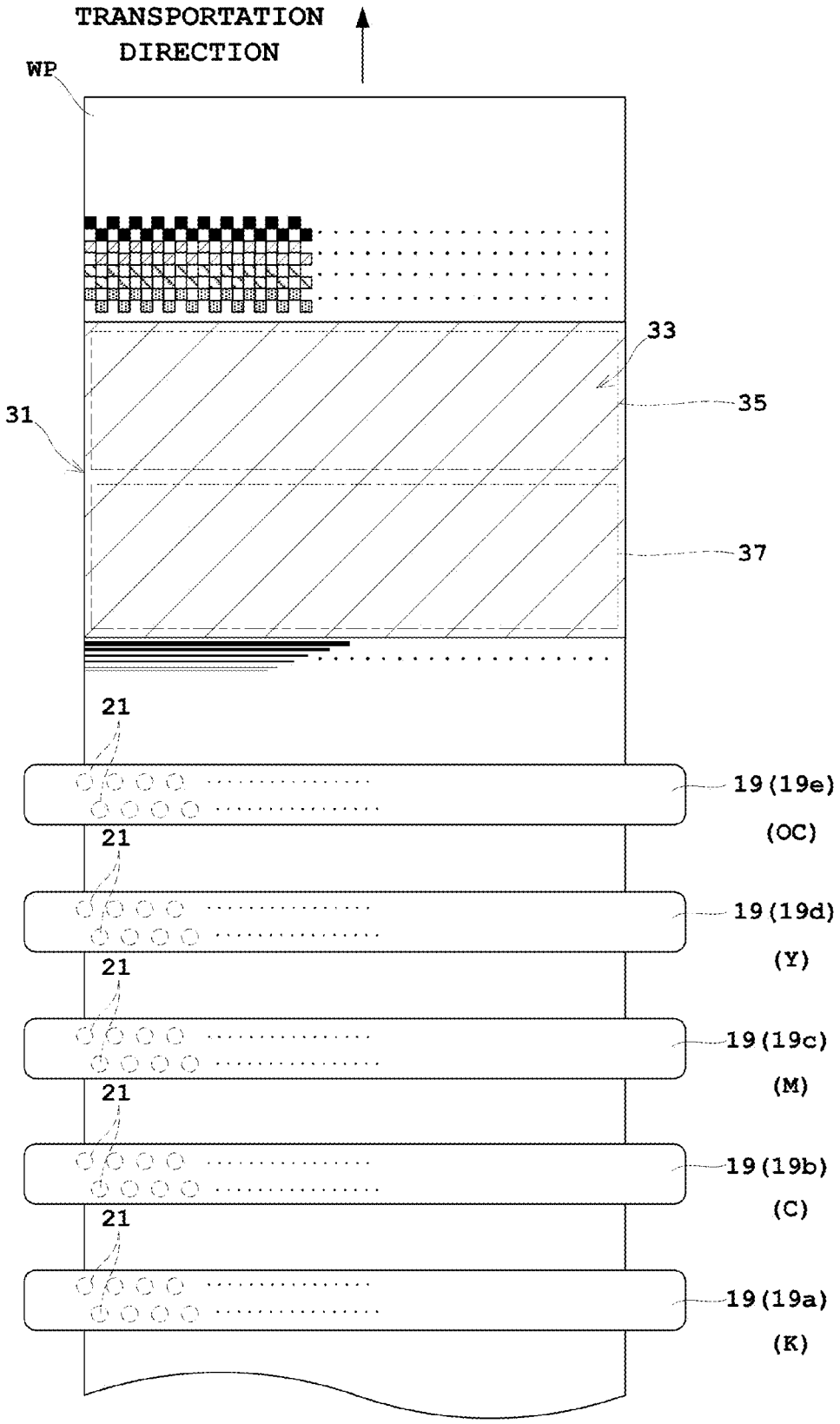
FIG. 2 is a schematic plan view of a positional relationship between web paper and each of printing heads.

FIG. 1 is a schematic view illustrating an entire inkjet printing system according to one embodiment of the present invention. FIG. 2 is a schematic plan view of a positional relationship between web paper and each of printing heads.

The inkjet printing system according to one embodiment of the present invention includes a paper feeder 1, an inkjet printing apparatus 3, and a take-up roller 5.

The paper feeder 1 holds the web paper WP in a roll form to be rotatable about a horizontal axis. The paper feeder 1 unwinds the web paper WP to feed the paper to the inkjet printing apparatus 3. The take-up roller 5 winds up the web paper WP printed by the inkjet printing apparatus 3 about a horizontal axis. Regarding the side from which the web paper WP is fed as upstream and the side to which the web paper WP is discharged as downstream, the paper feeder 1 is disposed upstream of the inkjet printing apparatus 3, whereas the take-up roller 5 is disposed downstream of the inkjet printing apparatus 3.

The inkjet printing apparatus 3 includes a drive roller 7 in an upstream position thereof for taking in the web paper WP from the paper feeder 1. The web paper WP unwound from the paper feeder 1 by the drive roller 7 is transported downstream toward the take-up roller 5 along a plurality of transport rollers 9. A drive roller 11 is disposed between the lowermost-stream transport roller 9 and the take-up roller 5. The drive roller 11 feeds the web paper WP travelling on the transport rollers 9 toward the take-up roller 5.

The above web paper WP corresponds to the "print medium" in the present invention.

Between the drive roller 7 and drive roller 11, the inkjet printing apparatus 3 has a printing unit 13, a drying unit 15, and an inspecting unit 17 arranged in this order from upstream. The drier 15 dries portions printed by the printing unit 13. The inspecting unit 17 inspects the printed portions for any stains or omissions.

The printing unit 13 has a plurality of printing heads 19 for discharging visible ink droplets and an invisible overcoating agent. For instance, this embodiment includes five printing heads 19. Here, the printing heads 19 are formed by printing heads 19*a*, 19*b*, 19*c*, 19*d*, and 19*e* in this order from upstream toward downstream. In this specification, when the printing heads 19 should be identified individually, an alphabetical numeral (e.g., a) is applied to the numeral 19. Otherwise, only the numeral 19 is indicated. The printing heads 19 each have a plurality of inkjet nozzles 21 for discharging ink droplets. A plurality of inkjet nozzles 21 is arranged in two rows in the transportation direction of the web paper WP. A first row of nozzles 21 and a second row of nozzles 21 are so arranged in a direction orthogonal to the transportation direction of the web paper WP as not to overlap each other in the transportation direction. The printing heads 19*a* to 19*e* each allow discharge of visible ink droplets in at least one color and at least one invisible overcoating agent onto the web paper WP. For instance, the printing head 19*a* discharges ink droplets in black (K), the printing head 19*b* discharges ink droplets in cyan (C), printing head 19*c* discharges ink droplets in magenta (M), the printing head 19*d* discharges ink droplets in yellow (Y), and the printing head 19*e* discharges an invisible overcoating agent. The printing heads 19*a* to 19*e* are spaced away from one another at given intervals in the transportation direction.

The printing head 19*e* correspond to the "overcoating head" in the present invention.

A controller 25 includes a CPU and a memory not shown. The controller 25 receives print data from an external computer, not shown, and converts the print data into print-processing data. Thereafter, the controller 25 operates the drive rollers 7 and 11 to transport the web paper WP while the printing heads 19 discharge ink droplets in accordance with the print-processing data, whereby an image based on the print data is printed on the web paper WP. The controller 25 stores in advance print-processing data for printing the inspecting chart onto the web paper WP. This is to be described hereinunder. When an operator of the inkjet printing system issues a command to print the inspecting chart, the controller 25 reads the print-processing data for the inspecting chart, and operates the drive rollers 7 and 11 and the printing heads 19 to print the inspecting chart on the web paper WP.

The controller 25 contains two types of mode as a printing mode. One type is a normal discharge mode, ant the other type is an inspecting discharge mode.

In the normal discharge mode, normal printing is performed to the web paper WP. The normal discharge mode has a printing rate in the web paper WP relative to a given area of less than 100% for printing onto the web paper WP. In the inspecting discharge mode, a discharge state of the overcoating agent from the printing head 19*e* is confirmed. The inspecting discharge mode has a printing rate in the web paper WP relative to a given area higher than the printing rate of the normal discharge mode. For instance, the normal discharge mode has the maximum printing rate of 95%, whereas the inspecting discharge mode has the maximum printing rate of 100%.

This results from a property of the inkjet printing apparatus 3. Specifically, ink droplets are discharged onto the web paper WP, the ink droplets spread on a surface of the web paper WP. Accordingly, a printing rate of 100% in the print data changes to a printing rate of 95%, for example, when the print data is converted into the print-processing data. In contrast to this, in the inspecting discharge mode, a printing rate of 100% in the print data remains 100% when the print data is converted into the print-processing data. Here, the inspecting discharge mode does not necessarily have a printing rate of 100% as long as the printing rate of the inspecting discharge mode is higher than the maximum printing rate of the normal discharge mode.

An operator operates a setting unit 27 to issue commands about printing to the controller 25. The controller 25 allows printing in the above two modes. When the setting unit 27 sets the inspecting discharge mode, the controller 25 operates to perform printing at a printing rate of 100% in an overcoating inspecting chart 31 to be mentioned hereinunder.

The overcoating inspecting chart 31 in the embodiment includes an inspecting region 33, a first inspecting chart 35, and a second inspecting chart 37.

For instance, the printing head 19*b* prints the inspecting region 33. The printing head 19*b* prints the inspecting region 33 at a printing rate of 100% with cyan ink droplets. In other words, printing in a solid condition is performed. Consequently, the inspecting region 33 has ink evenness higher than the inspecting region printed at a printing rate of 95%. Thereafter, the printing head 19*e* discharges an overcoating agent to print the first and second inspecting chart 35 and 37.

Figure 3:
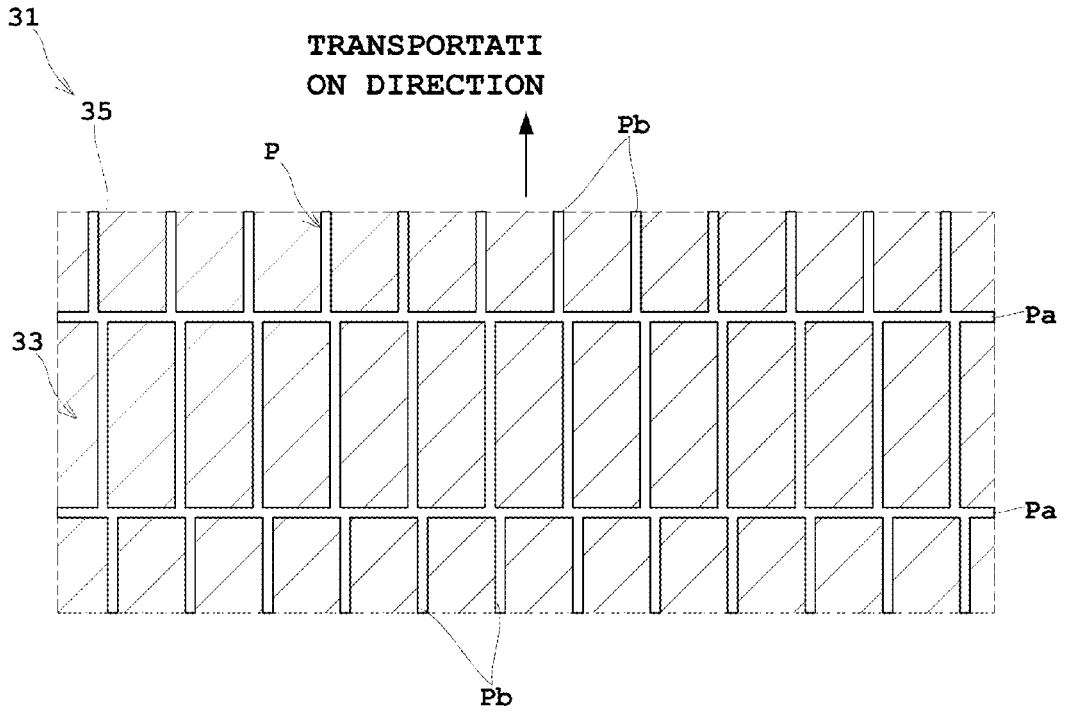
FIG. 3 is a schematic view of an overcoating inspecting chart (first inspecting chart) from print-processing data.
Figure 4:
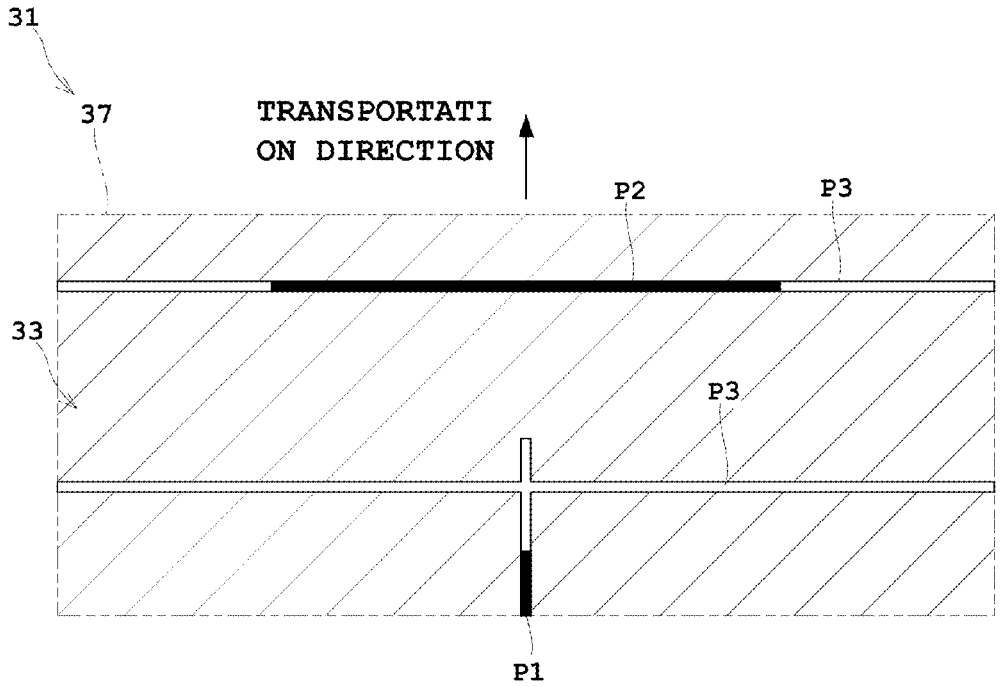
FIG. 4 a schematic view of an overcoating inspecting chart (second inspecting chart) from the print-processing data.

The following describes the first and second inspecting chart 35 and 37 with reference to FIGS. 3 and 4. FIG. 3 is a schematic view of the overcoating inspecting chart (first inspecting chart) from print-processing data. FIG. 4 a schematic view of the overcoating inspecting chart (second inspecting chart) from print-processing data.

The first inspecting chart 35 with a pattern P is printed in the inspecting region 33. The pattern P is a form of discharging the overcoating agent from an individual nozzle 21 of the printing head 19*e*. The pattern P includes a pattern Pa in a direction orthogonal to the transportation direction. The pattern Pa is printed linearly in the direction orthogonal to the transportation direction with the overcoating agent from the individual nozzle 21 of the printing head 19*e*. The nozzles 21 are arranged in the direction orthogonal to the transportation direction. The pattern P includes a pattern Pb in the transportation direction. The pattern Pb is printed by every nozzle 21 with shift in the transportation direction such that the overcoating agent discharged from the adjacent nozzles 21 is visible, the nozzles 21 being arranged in the direction orthogonal to the transportation direction.

The second inspecting chart 37 is formed by a first pattern P1, a second pattern P2, and a third pattern P3 overlapping the patterns P1 and P2. These patterns are printed by the printing head 19*a* on the uppermost stream side. The first pattern P1 is linear in the transportation direction. The second pattern P2 is linear in the direction orthogonal to the transportation direction. Moreover, the second inspecting chart 37 has a cross shape as the third pattern P3. The cross shape contains a line along the first pattern P1 and a line in the direction orthogonal to the transportation direction. The third pattern P3 also includes a line along the second pattern P2.

Figure 5:
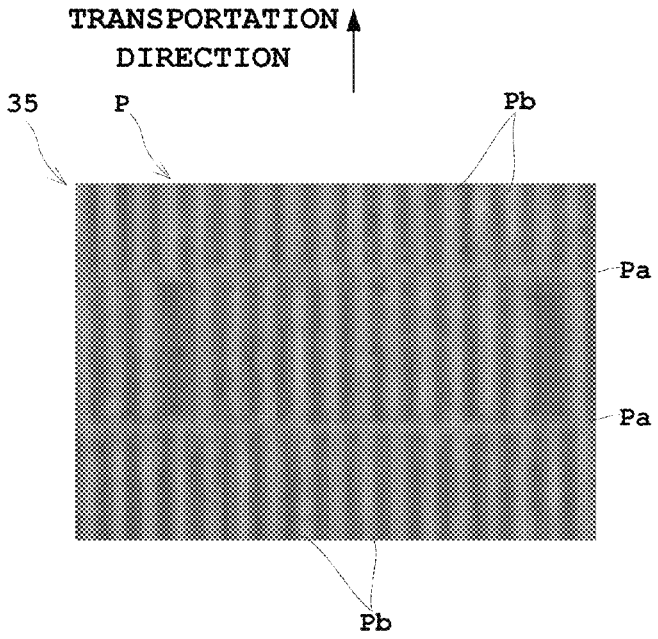
FIG. 5 is an example of actual printing of the overcoating inspecting chart (first inspecting chart).
Figure 6:
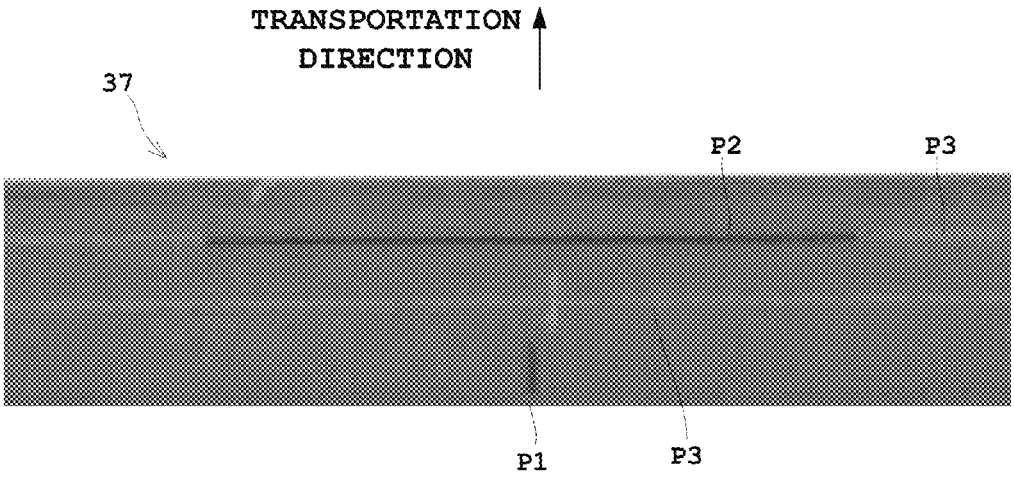
FIG. 6 is an example of actual printing of the overcoating inspecting chart (second inspecting chart).

The following describes actual printing results of the first and second inspecting charts 35 and 37 with reference to FIGS. 5 and 6. FIG. 5 is an example of actual printing of the overcoating inspecting chart (first inspecting chart). FIG. 6 is an example of actual printing of the overcoating inspecting chart (second inspecting chart).

It is readily seen from FIG. 5 that two patterns Pb are missing. This occurs from bleeding of the overcoating agent into ink droplets, the overcoating agent being discharged while ink droplets fail to be absorbed. Such bleeding results from printing of the overcoating agent onto the inspecting region 33 printed in cyan at a printing rate of 100%.

Moreover, it is seen from the FIG. 6 that no shift of the third pattern P3 relative to the second pattern P2 occurs in the transportation direction. On the other hand, it is explicitly seen that the third pattern P3 in a cross shape is largely shifted relative to the first pattern P1 in the direction orthogonal to the transportation direction. This reveals that skew or serpentine transportation causes shift in discharge position of the printing head 19*a* for black (K) to the printing head 19*e* for overcoating (OC).

With the embodiment of the present invention, the controller 25 operates the printing head 19 to form the inspecting region 33 in the web paper WP, and operates the printing head 19*e* to discharge the overcoating agent onto the inspecting region 33 in the inspecting discharge mode. Consequently, the overcoating inspecting chart 31 is formed. The inspecting region 33 is printed in the inspecting discharge mode. Accordingly, the inspecting region 33 is printed in a condition more solid than the normal discharge mode. Consequently, the inspecting region 33 has ink evenness higher than the inspecting region printed in the normal discharge mode. Moreover, the overcoating agent is discharged onto a sheet with difficulty in absorbing ink droplets, such as a coated paper, prior to absorption of the ink droplets into the sheet. This causes bleeding of the ink droplets and change in color of the ink droplets. Consequently, the overcoating inspecting chart 31 obtains an enhanced visibility even with an invisible overcoating agent. As a result, a discharge state of the overcoating agent can be confirmed readily at low prices without a special overcoating agent.

Moreover, the individual nozzle 21 performs discharge in the second inspecting chart 35 with shift in the transportation direction. Accordingly, the overcoating agent from the adjacent nozzles 21 is visible even when the overcoating agent spreads in the inspecting region 33. This achieves confirmation of a discharge state of the overcoating agent from each of the nozzles 31.

Moreover, an overlap condition of the first pattern P1 and the second pattern P2 allows confirmation of difference in discharge position between the printing head 19*a* for black (K) and the overcoating head 19*e* for the overcoating agent.

The present invention is not limited to the foregoing examples, but may be modified as follows.

(1) The above embodiment describes the web paper WP as one example of the print medium. However, the print medium is not limited to paper in the present invention. Examples of the print medium include a film.

(2) In the above embodiment, the inspecting region 33 is printed in cyan (C). Alternatively, the inspecting region 33 may be printed in other colors depending on types of the overcoating agent.

(3) The above embodiment describes the case as one example in which the first and second inspecting charts 35 and 37 are printed as the overcoating inspecting chart 31. However, the present invention is not limited to this. In the present invention, at least the first inspecting chart 35 may be printed as the overcoating inspecting chart 31.

The present invention may be embodied in other specific forms without departing from the spirit or essential attributes thereof and, accordingly, reference should be made to the appended claims, rather than to the foregoing specification, as indicating the scope of the invention.

What is claimed is:

1. An inkjet printing apparatus for discharging ink droplets and an overcoating agent, the apparatus comprising:

a printing head discharging the ink droplets;

an overcoating head discharging the overcoating agent; and a controller operating the printing head and the overcoating head to perform printing to a print medium, the controller operating in an inspecting discharge mode forming an inspecting region at a printing rate in the print medium relative to a given area higher than the maximum of a printing rate of a normal discharge mode for confirming a discharge state of the overcoating agent, the maximum of the printing rate of the normal discharge mode in the print medium relative to a given area being less than 100% for the printing to the print medium, and in the inspecting discharge mode, the controller operating the printing head to form the inspecting region on the print medium, and operating the overcoating head to discharge the overcoating agent onto the inspecting region so as to produce shift linearly in a direction orthogonal to a transportation direction of the print medium and in the transportation direction, whereby an overcoating inspecting chart is formed.

2. The inkjet printing apparatus according to claim 1, wherein the inspecting region is formed by discharging ink droplets in cyan (C) from the printing head.

3. The inkjet printing apparatus according to claim 2, wherein the printing head includes a plurality of printing heads, one of the plurality on the uppermost stream side discharging ink droplets in black (K), and the controller operates the printing head discharging the ink droplets in black (K) to print a first pattern drawn along a transportation direction and a second pattern drawn in a direction orthogonal to the transportation direction in a region corresponding to the inspecting region, and operates the overcoating head to discharge the overcoating agent so as for the overcoating agent to overlap the first pattern and the second pattern.

4. The inkjet printing apparatus according to claim 3, wherein the normal discharge mode has the maximum printing rate of 95%, whereas the inspecting discharge mode has the maximum printing rate of 100%.

5. The inkjet printing apparatus according to claim 2, wherein the normal discharge mode has the maximum printing rate of 95%, whereas the inspecting discharge mode has the maximum printing rate of 100%.

6. The inkjet printing apparatus according to claim 1, wherein the printing head includes a plurality of printing heads, one of the plurality on the uppermost stream side discharging ink droplets in black (K), and the controller operates the printing head discharging the ink droplets in black (K) to print a first pattern drawn along a transportation direction and a second pattern drawn in a direction orthogonal to the transportation direction in a region corresponding to the inspecting region, and operates the overcoating head to discharge the overcoating agent so as for the overcoating agent to overlap the first pattern and the second pattern.

7. The inkjet printing apparatus according to claim 6, wherein the normal discharge mode has the maximum printing rate of 95%, whereas the inspecting discharge mode has the maximum printing rate of 100%.

8. The inkjet printing apparatus according to claim 1, wherein the normal discharge mode has the maximum printing rate of 95%, whereas the inspecting discharge mode has the maximum printing rate of 100%.

9. A method of printing an inspecting chart with an inkjet printing apparatus discharging ink droplets and an overcoating agent, the method comprising:

forming an inspecting region on a print medium in an inspecting discharge mode having a printing rate in the print medium relative to a given area higher than the maximum of a printing rate of a normal discharge mode of less than 100% for printing to the print medium; and forming an overcoating inspecting chart by discharging the overcoating agent onto the inspecting region so as to produce shift linearly in a direction orthogonal to a transportation direction of the print medium and in the transportation direction for confirming a discharge state of the overcoating agent.

10. The method of printing the inspecting chart with the inkjet printing apparatus according to claim 9, wherein the inspecting region is formed by ink droplets in cyan (C).

* * * * *